US006502810B1

(12) United States Patent
Ramoski

(10) Patent No.: US 6,502,810 B1
(45) Date of Patent: Jan. 7, 2003

(54) CLAMPING STAND

(76) Inventor: Robert J. Ramoski, 6449 Tillery Rd., Lakeland, FL (US) 33813-3839

( * ) Notice: Subject to any disclaimer, the term of this patent is extended or adjusted under 35 U.S.C. 154(b) by 0 days.

(21) Appl. No.: 10/159,920

(22) Filed: Jun. 3, 2002

(51) Int. Cl.[7] ..... B25B 1/16
(52) U.S. Cl. ..... 269/158; 269/902; 254/133 R
(58) Field of Search ..... 269/158, 902, 269/157, 160, 162, 163, 259, 254 CS, 296, 261, 262, 282, 283; 254/133 R

(56) References Cited

U.S. PATENT DOCUMENTS 3,765,650 A * 10/1973 Eisenhauer ..... 254/133 R
4,540,147 A * 9/1985 Lincourt ..... 254/133 R
4,899,963 A * 2/1990 Murphy ..... 254/133 R
5,727,779 A * 3/1998 Ramoski ..... 269/158

FOREIGN PATENT DOCUMENTS

GB 2089763 * 6/1982 ..... 254/133 R

* cited by examiner

*Primary Examiner*—Lee Wilson
(74) *Attorney, Agent, or Firm*—George A. Bode; Lisa D. Velez; Bode & Associates

(57) ABSTRACT

A clamping stand having a workpiece tray that includes a planar surface that is adapted to be clamped in the tray. The planar surface includes two spaced-apart parallel surfaces joined together via a V-shaped channel. One of the surface includes a notch which is adapted to receive an arm of the clamping member to clamp the workpiece either in the V-shaped channel or on top of the planar surface.

16 Claims, 4 Drawing Sheets

CLAMPING STAND

BACKGROUND OF THE INVENTION

1. Field of the Invention

The present invention relates to clamping devices and, more particularly, to a new clamping stand for holding and clamping a workpiece in a fixed position so that work may be performed on the workpiece.

2. General Background

The use of clamping devices is known in the prior art. For example, U.S. Pat. No. 5,727,779, issued to this inventor, entitled "CLAMPING STAND," discloses a V-shaped workpiece tray supported vertically upright by a leg assembly having a vertical support. The clamping is actuated by a stirrup and secures the workpiece in the V-shaped channel by moving an arm within a notch in the tray. While, the V-shaped channel adequately holds a pipe or rod, planarly dimensioned workpieces such as without limitation boards are not adequately supported or clamped.

An object of the present invention is to provide a workpiece tray that is multi-functional and can securely clamp multi-dimensionally different workpieces.

SUMMARY OF THE PRESENT INVENTION

The preferred embodiment of improved clamping stand of the present invention solves the aforementioned problems in a straight forward and simple manner.

Broadly, the present invention contemplates a clamping stand having a workpiece tray that includes a planar surface for supporting a workpiece in a clamped position in the tray. The planar surface includes two spaced-apart parallel surfaces joined together via a V-shaped channel. One of the surface includes a notch which is adapted to receive an arm of the clamping member to clamp the workpiece either in the V-shaped channel or on top of the planar surface.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figures 7, 8, 9:
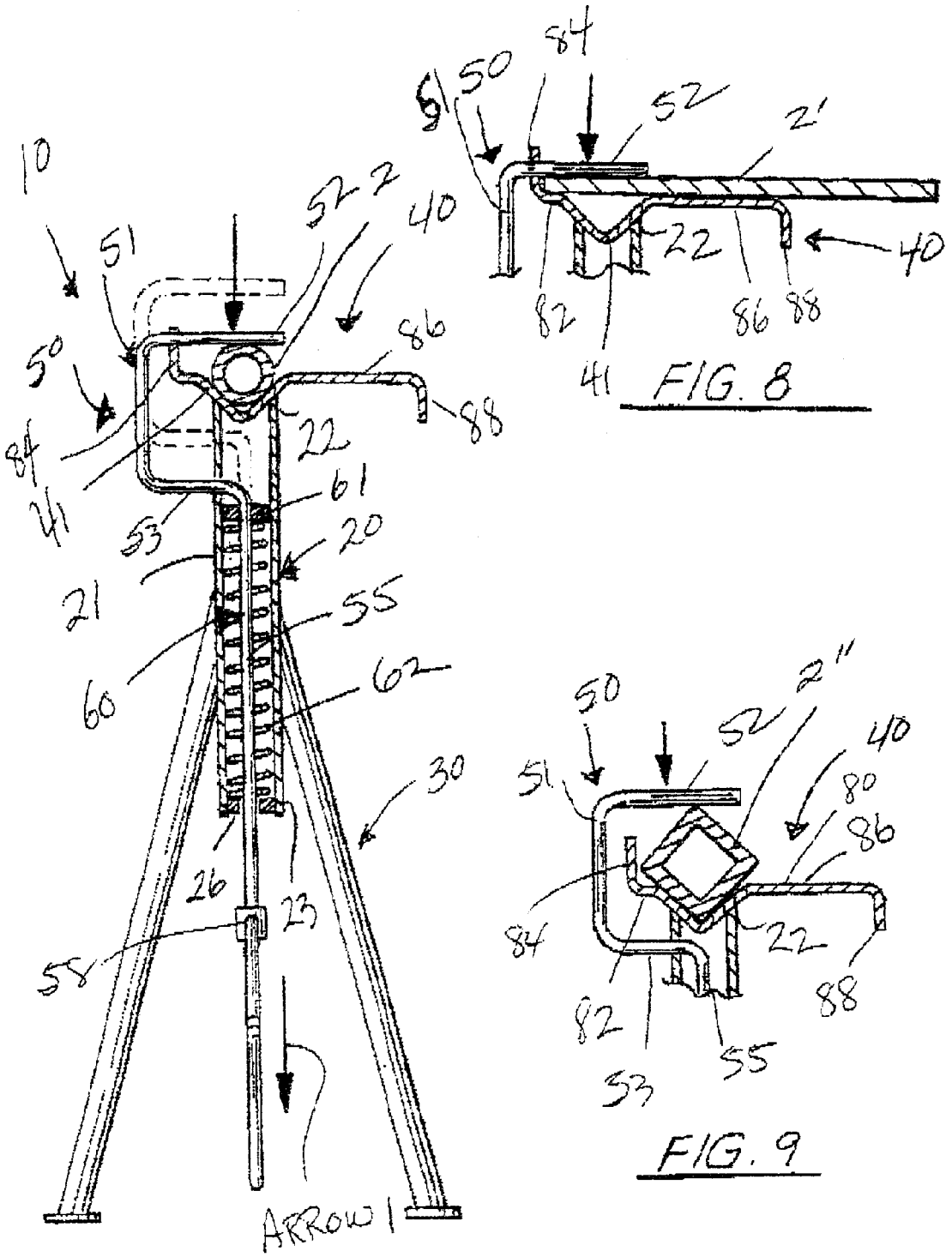
FIG. 7 is a cross-sectional view of the new clamping stand according to the present invention with the clamping member in a clamping position holding a rod or pipe in the V-shaped channel, an unclamped position shown is in phantom.
FIG. 8 is a top cross-sectional view of the new clamping stand according to the present invention with the clamping member in a clamping position holding a board or other planar workpiece on the planar surface of the workpiece tray; and, FIG. 9 is a cross-sectional view of the new clamping stand according to the present invention with the clamping member in a clamping position holding a square-shaped workpiece.

Referring now to the drawings and in particular FIGS. 1–7, the clamping stand of the present invention is generally referenced by the numeral 10. The clamping stand 10 comprises a vertical support member 20, a leg assembly 30 extending downward from one end of the vertical support member 20, a workpiece tray 40 provided at an opposite end of the vertical support member 20 for holding a workpiece 2, 2' or 2" and a clamping member 50 movable relative to the workpiece tray 20 for clamping the workpiece 2, 2' or 2" in the workpiece tray 40. A stirrup 59, adapted to receive a foot of a user of the stand 10, extends downward from the clamping member 50, whereby downward movement of the stirrup 59 causes the clamping member 50 to move downward against a workpiece 2, 2' or 2" positioned in the workpiece tray 40 thereby clamping the workpiece 2, 2' or 2" in the workpiece tray 40, as best seen in FIGS. 7–9.

Figure 4:
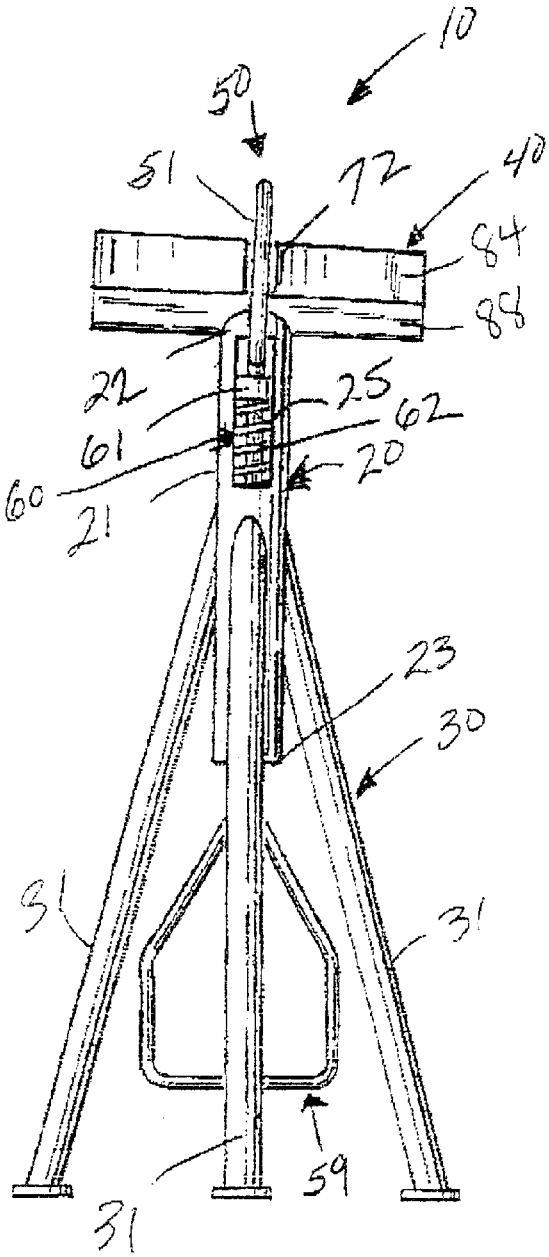
FIG. 4 is a rear or back elevational view of the new clamping stand according to the present invention;.

As best illustrated in FIGS. 4 and 7, it can be shown that the vertical support member 20 comprises a cylindrical sleeve 21 having a first end 22 and a second end 23. The cylindrical sleeve 21 has a vertical slot 25 therein adjacent the first end 22. As best illustrated in FIG. 7, it can be shown that a lip 26 is provided within the cylindrical sleeve 21 adjacent the second end 23.

Figure 1:
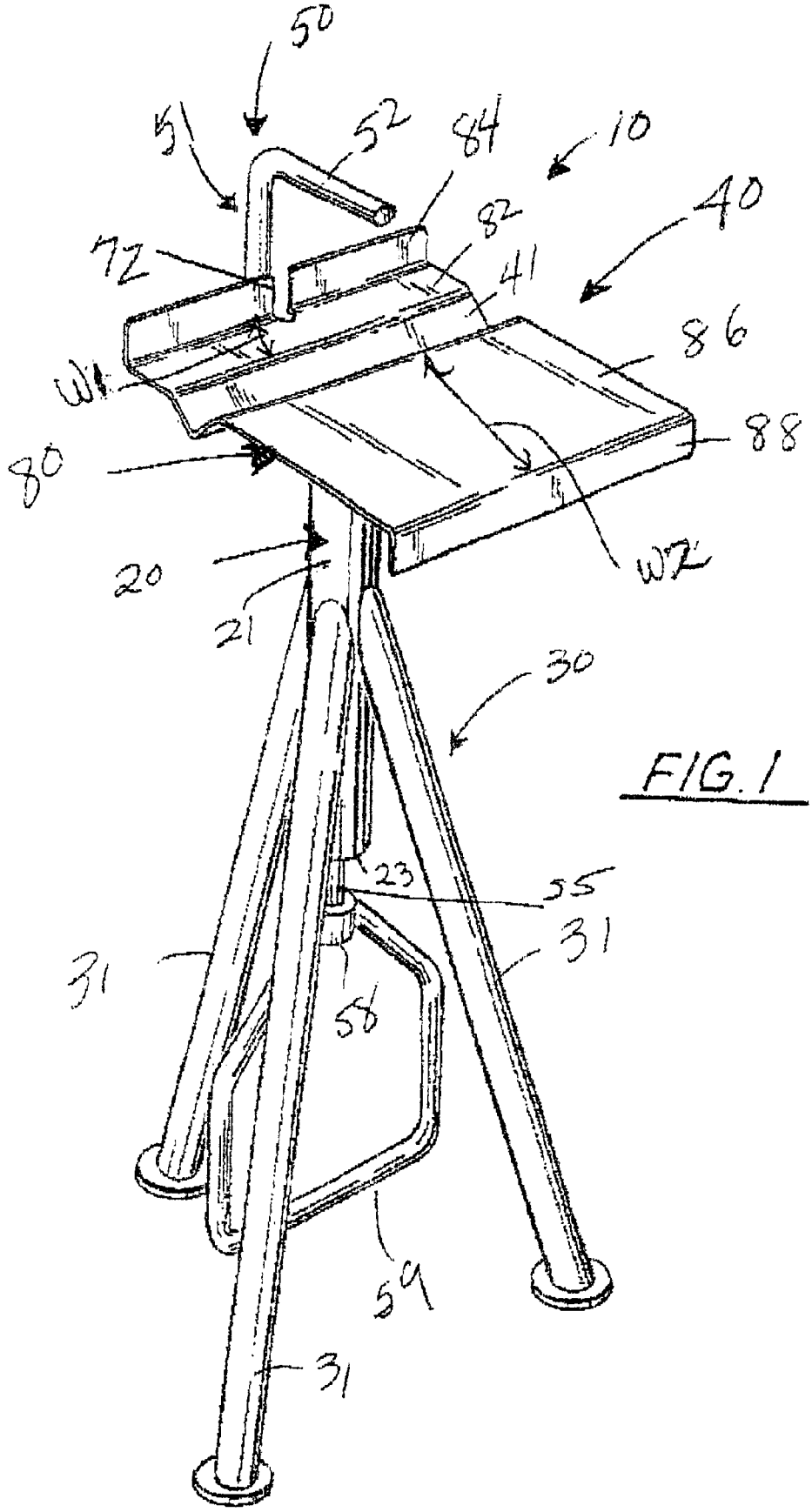
FIG. 1 illustrates a top, front and left side perspective view of the preferred embodiment of the new clamping stand according to the present invention.
Figure 2:
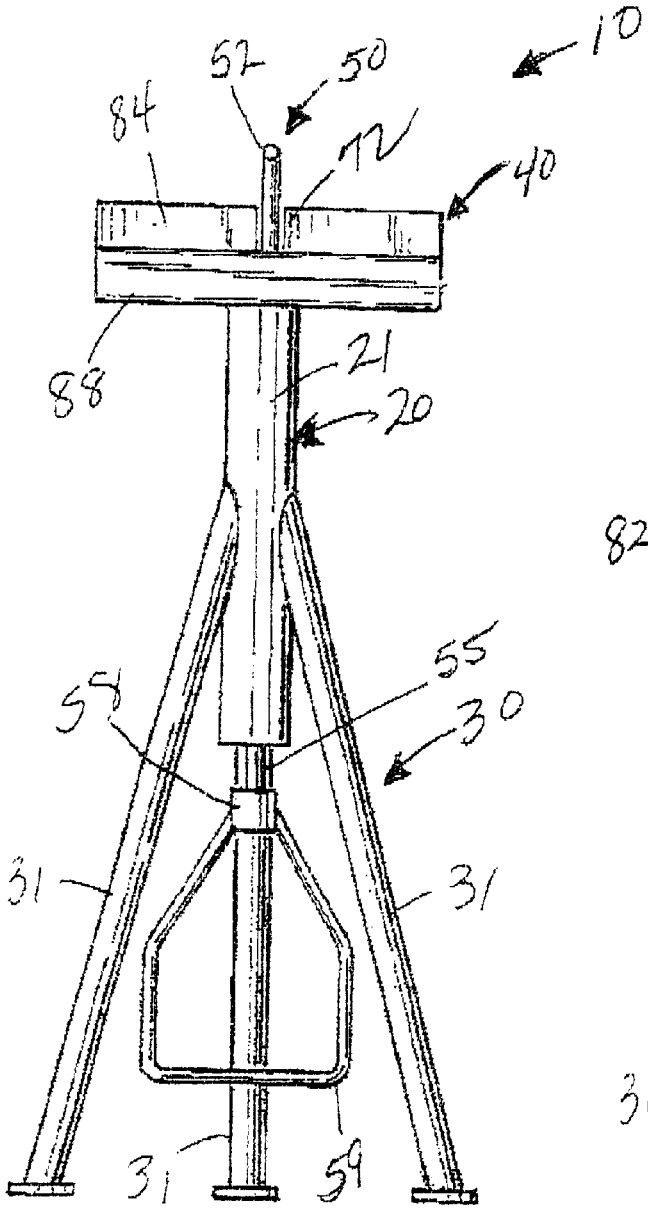
FIG. 2 is a front elevational view of the new clamping stand according to the present invention.
Figure 3:
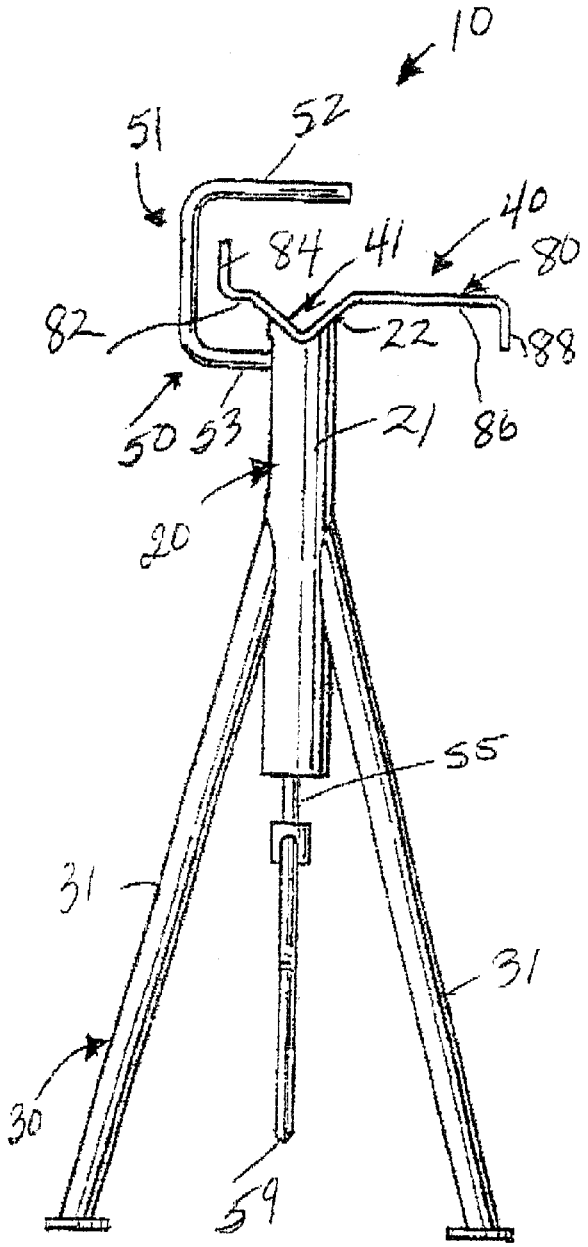
FIG. 3 is a left side elevational view of the new clamping stand according to the present invention.

As best illustrated in FIGS. 1 and 3, it can be shown that the leg assembly 30 is attached to an extends downward from the second end 23 of the cylindrical sleeve 21. The leg assembly 30 comprises three legs 31 each attached to the second end 23 of the cylindrical sleeve 21. The three legs 31 extend downward from the cylindrical sleeve 21 in a diverging relationship.

As best illustrated in FIGS. 1–4 and 7–9, it can be shown that the workpiece tray 40 is attached to the first end 22 of the cylindrical sleeve 21. The workpiece tray 40 comprises a planar surface 80 having first and second spaced-apart parallel surfaces 82 and 86. The longitudinally parallel free ends of first and second surfaces 82 and 86 are joined together via a V-shaped channel 41 adapted to hold a variety of workpieces 2, 2' or 2", as shown in FIGS. 7–9, in a generally horizontal position. The V-shaped channel 41 can accommodate pipes, conduits and rods (workpieces 2 and 2"). The planar surface 80 is adapted to support thereon boards, wood, other large objects (workpiece 2') that can be placed on planar surface 80 and which do not fit within the V-shaped channel 41.

The other free longitudinal side of the first surface 82 has perpendicularly coupled thereto flange 84 which depends upward. The other free longitudinal side of the second surface 86 has perpendicularly coupled thereto a lip 88 which depends downward.

A notch 72 is provided in flange 84 of the workpiece tray 40. The notch 72 is aligned with the clamping member 50 and allows for adequate downward movement of the clamping member 50 against the workpiece 2, 2' or 2"in the V-shaped channel 41 or the planar surface 80, as best seen in FIGS. 7–9.

In the exemplary embodiment, the first surface 82 has a width W1 while the second surface 86 has a width W2 which is longer than the width W1. Nevertheless, the widths W1 and W2 could be the same or reversed in dimensionality.

As best illustrated in FIG. 7, it can be shown that the clamping member 50 includes a clamping portion 51 and a shaft portion 55. The clamping portion 51 is generally C-shaped and includes an upper arm 52 and a lower arm 53. The upper arm 52 is substantially horizontal and positioned above the workpiece tray 40. The upper arm 52 provides a single contact against the workpiece 2, 2' or 2". The notch 72 in the workpiece tray 40 allows the upper arm 52 of the clamping portion 51 to penetrate the workpiece tray 40 and clamp the workpiece 2, 2' or 2" in the workpiece tray 40 either to the planar surface 80 or the V-shaped channel 41. The lower arm 53 of the clamping portion 51 fits within the vertical slot 25 provided in the cylindrical sleeve 21. The shaft portion 55 of the clamping member 50 is slidably mounted within the cylindrical sleeve 21.

As best illustrated in FIGS. 1–3 and 7, it can be shown that the stirrup 59 is attached to and extends downward from the shaft portion 55 of the clamping member 50. A coupling 58 removably attaches the stirrup 59 to the shaft portion 55 of the clamping member 50. Downward movement (ARROW 1) of the stirrup 59 causes the clamping member 50 to move downward whereby the lower arm 53 of the clamping portion 51 travels downward within the vertical slot 25 provided in the cylindrical sleeve 21. Likewise, the upper arm 52 of the clamping portion 51 moves downward and engages the workpiece 2, 2' or 2" holding and clamping the workpiece 2, 2' or 2" in and against the workpiece tray 40.

Figure 5:
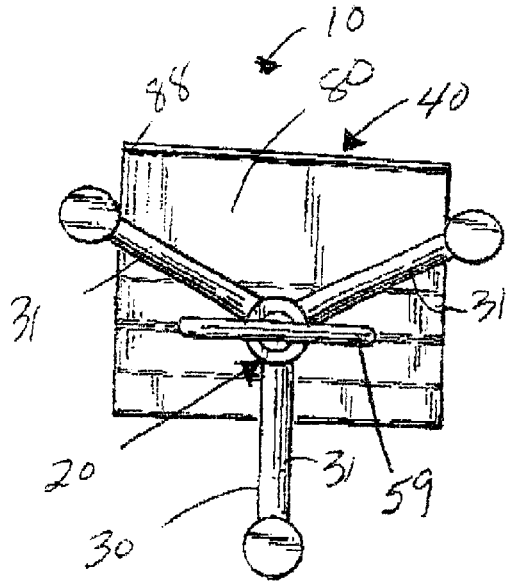
FIG. 5 is a bottom plan view of the new clamping stand according to the present invention.
Figure 6:
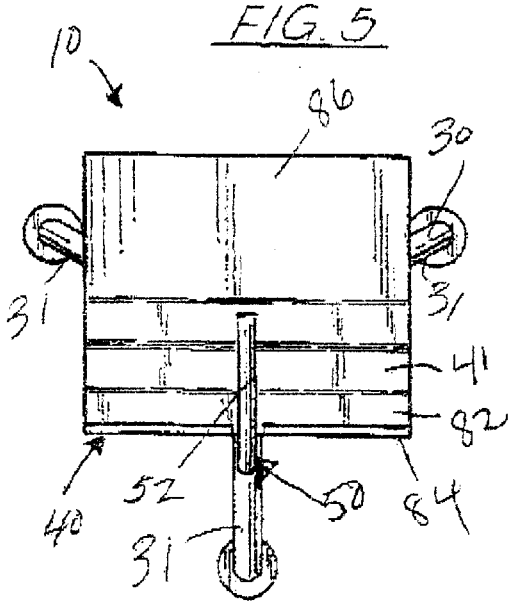
FIG. 6 is a top plan view of the new clamping stand according to the present invention.

As best illustrated in FIG. 5, it can be shown that a spring means 60 is provided for urging the upper arm 52 of the clamping portion 51 of the clamping member 50 above and away from the workpiece tray 40. The spring means 60 comprises a ring 61 slidably fitted within the cylindrical sleeve 21 and concentrically attached to the shaft portion 55 of the clamping member 50. Spring 62 is located within the cylindrical sleeve 21 and positioned around the shaft portion 55 of the clamping member 50. The spring 62 is positioned between the ring 61 and the lip 26 provided within the cylindrical sleeve 21. Downward movement of the stirrup 59 compresses the spring 62 between the ring 61 and the lip 26.

In use, a user of the stand 10 places a workpiece 2, 2' or 2" in the workpiece tray 40. The user inserts a foot in the stirrup 59 and steps down whereby the lower arm 53 of the clamping portion 51 travels downward within the vertical slot 25 provided in the cylindrical sleeve 21. Furthermore, the upper arm 52 of the clamping portion 51 moves downward and engages the workpiece 2, 2' or 2" holding and clamping the workpiece 2, 2' or 2" in and against the workpiece tray 40. With the workpiece 2, 2' or 2" held and clamped in the workpiece tray 40, the user can easily work on the workpiece 2, 2' or 2". When finished working on the workpiece 2, 2' or 2", the user removes his or her foot from the stirrup 59, whereby the spring means 60 urges the upper arm 52 of the clamping portion 51 of the clamping member 50 above and away from the workpiece tray 40 thereby allowing the user to remove the workpiece 2, 2' or 2" from the workpiece tray 40.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An apparatus for holding and clamping a workpiece comprising:

a leg assembly having a vertical support member and legs extending downward from one end of said vertical support member;

a workpiece tray attached a top end of the vertical support, said workpiece tray comprising a planar surface having a V-shaped channel, first and second spaced-apart parallel surfaces joined together via said V-shaped channel, and a flange depending upward from said first surface, said flange having a notch;

a clamping member movable relative to said workpiece tray for clamping s aid workpiece in said workpiece tray, said clamping member aligned with said notch to penetrate said workpiece tray during clamping; and, a stirrup extending downward from said clamping member whereby downward movement of said stirrup causes said clamping member to engage and clamp said workpiece in said workpiece tray.

2. The apparatus of claim 1, wherein said clamping member includes:

a clamping portion having an upper arm and a lower arm, said upper arm positioned above said workpiece tray and adapted to engage said workpiece, said lower arm slidably fitting within a vertical slot in said vertical support member; and a shaft portion slidably mounted within said vertical support member.

3. The apparatus of claim 2, wherein said stirrup is adapted to receive a foot of a user of said apparatus for effectuating the downward movement as pressure is applied by said foot to said stirrup.

4. The apparatus of claim 2, further comprising means for urging said upper arm of said clamping portion of said clamping member above and away from said workpiece tray.

5. the apparatus of claim 4, further comprising a lip provided within said vertical support member adjacent a lower end thereof, and wherein said urging means comprises:

a ring attached to said shaft portion of said clamping member and slidably fined within said vertical support member, and a spring located within said vertical support member and disposed around said shaft portion of said clamping member, said spring positioned between said ring and said lip whereby said spring urges said upper arm of said clamping member above and away from said workpiece tray and whereby downward movement of said stirrup compresses said spring between said ring and said lip.

6. The apparatus of claim 1, wherein said leg assembly comprises:

three legs each attached to and extending downward from said vertical support member in a diverging relationship.

7. The apparatus of claim 1, wherein:

said first surface has a first width;

said second surface has a second width which is longer than said first width.

8. The apparatus of claim 1, wherein the clamping member clamps a workpiece in either of the V-shaped channel or along the top of the first and second surfaces of said planar surface.

9. An apparatus for holding and clamping a workpiece comprising:

means for supporting a workpiece comprising a planar surface having a V-shaped channel, first and second spaced-apart parallel surfaces joined together via said V-shaped channel, and a flange depending upward from said first surface, said flange having a notch;

means for vertically elevating said workpiece supporting means having a vertical support member and legs extending downward from one end of said vertical support member;

means for clamping movable relative to said workpiece supporting means for clamping said workpiece in said workpiece supporting means, said clamping means aligned with said notch to penetrate said workpiece supporting means during clamping; and, mean for actuating said clamping means extending downward from said clamping means whereby downward movement of said actuating means causes said clamping means to engage and clamp said workpiece in said workpiece supporting means.

10. The apparatus of claim 9, wherein said clamping means includes:

a clamping portion having an upper arm and a lower arm, said upper arm positioned above said workpiece supporting means and adapted to engage said workpiece, said lower arm slidably fitting within a vertical slot in said vertical support member; and a shaft portion slidably mounted within said vertical support member.

11. The apparatus of claim 10, wherein said actuating means is adapted to receive a foot of a user of said apparatus for effectuating the downward movement as pressure is applied by said foot to said actuating means.

12. The apparatus of claim 10, further comprising means for urging said upper arm of said clamping portion of said clamping means above and away from said workpiece supporting means.

13. the apparatus of claim 12, further comprising a lip provided within said vertical support member adjacent a lower end thereof, and wherein said urging means comprises:

a ring attached to said shaft portion of said clamping means and slidably fined within said vertical support member; and, a spring located within said vertical support member and disposed around said shaft portion of said clamping means, said spring positioned between said ring and said lip whereby said spring urges said upper arm of said clamping means above and away from said workpiece supporting means and whereby downward movement of said actuating means compresses said spring between said ring and said lip.

14. The apparatus of claim 9, wherein said elevating means comprises:

three legs each attached to and extending downward from said vertical support member in a diverging relationship.

15. The apparatus of claim 9, wherein:

said first surface has a first width;

said second surface has a second width which is longer than said first width.

16. The apparatus of claim 9, wherein the clamping means clamps said workpiece in either of the V-shaped channel or along the top of the first and second surfaces of said planar surface.

* * * * *